US006401500B1

(12) United States Patent
Froelicher et al.

(10) Patent No.: US 6,401,500 B1
(45) Date of Patent: Jun. 11, 2002

(54) WASHING MACHINE BRAKE ROLLER THRUST BEARING

(75) Inventors: Stephen Bernard Froelicher, Shepherdsville; David Edward Norton, Louisville, both of KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/067,186

(22) Filed: Apr. 27, 1998

Related U.S. Application Data

(60) Provisional application No. 60/044,342, filed on Apr. 28, 1997.

(51) Int. Cl.[7] ..... D06F 37/40

(52) U.S. Cl. ..... 68/23.7; 68/23.3; 68/133; 474/170

(58) Field of Search ..... 68/23.3, 23.7, 68/133; 74/20, 25; 474/170

(56) References Cited

U.S. PATENT DOCUMENTS

| | | | | | |
|---|---|---|---|---|---|
| 2,609,697 | A | * | 9/1952 | Ruscoe | 68/23.7 |
| 2,720,955 | A | * | 10/1955 | Young | 68/23.7 |
| 2,751,773 | A | * | 6/1956 | Woodson | 68/23.7 |
| 2,976,746 | A | * | 3/1961 | Flannery | 68/23.7 |
| 3,575,057 | A | | 4/1971 | Kurowski | |
| 3,845,642 | A | | 11/1974 | Cochran | |
| 3,973,660 | A | * | 8/1976 | Leopold et al. | |
| 4,024,799 | A | * | 5/1977 | Forster | |
| 4,059,975 | A | * | 11/1977 | Jacobs | 68/133 |
| 4,283,928 | A | * | 8/1981 | Stone | |
| 4,391,351 | A | * | 7/1983 | Jirousek et al. | |
| 4,397,198 | A | * | 8/1983 | Borgersen et al. | |
| 4,687,411 | A | * | 8/1987 | Maeda et al. | |
| 4,936,742 | A | * | 6/1990 | Eguchi et al. | |
| 5,157,966 | A | * | 10/1992 | Lugosi et al. | |
| 5,261,750 | A | * | 11/1993 | Eckhardt et al. | |
| 5,474,390 | A | * | 12/1995 | Rhoads | |
| 5,509,284 | A | * | 4/1996 | Hauser | 68/23.7 |
| 5,522,242 | A | * | 6/1996 | Hauser | 68/23.7 |
| 5,605,212 | A | * | 2/1997 | Hauser | 68/23.7 |
| 5,732,574 | A | | 3/1998 | Hauser | |
| 5,740,701 | A | * | 4/1998 | Hauser | 68/23.7 |
| 5,741,762 | A | * | 4/1998 | Kahlman | |
| 5,809,808 | A | * | 9/1998 | Andriano et al. | 68/23.7 |
| 5,887,458 | A | * | 3/1999 | Bae | 68/23.7 |
| 5,926,887 | A | | 7/1999 | Thompson et al. | |
| 5,957,803 | A | * | 9/1999 | Fini, Jr. | |
| 6,148,646 | A | | 11/2000 | Koshiga et al. | |
| 6,270,442 | B1 | | 8/2001 | Folino et al. | |

* cited by examiner

*Primary Examiner*—Frankie L. Stinson
(74) *Attorney, Agent, or Firm*—Armstrong Teasdale LLP

(57) ABSTRACT

A thrust bearing assembly for absorbing forces on an input shaft of a washing machine is described. In one embodiment, the thrust bearing assembly is located at an upper end of the input shaft just below a pinion gear coupled to the shaft. The thrust bearing assembly includes a cage and bearing assembly positioned between washers. The thrust bearing assembly is supported on a bronze flange bearing having a bore, and the input shaft extends through the bore. The flange bearing is supported by the transmission housing, and a lubrication reservoir is formed by the transmission housing. The reservoir typically is filled with a lubricant. In operation, when the machine operates in the spin cycle, axial forces are transferred through an actuator cam, a pulley hub, and the shaft to the thrust bearing assembly. The thrust bearing assembly cooperates with the transmission housing to absorb the downward axial forces on shaft.

9 Claims, 3 Drawing Sheets

WASHING MACHINE BRAKE ROLLER THRUST BEARING

CROSS REFERENCE TO RELATED APPLICATION

This application claims the benefit of U.S. Provisional Application No. 60/044,342, filed Apr. 28, 1997.

FIELD OF THE INVENTION

This invention relates generally to washing machines for washing fabrics and items of clothing and more particularly, to a roller thrust bearing assembly for a washing machine brake.

BACKGROUND OF THE INVENTION

Known clothes washing machines generally include a cabinet enclosing an outer water-retaining tub and a basket is located within the tub. A transmission is located adjacent the tub and the transmission produces both an agitating movement and a continuous direct spin depending on the rotation direction of the motor. Particularly, an input shaft extends to the transmission from a pulley which is coupled to the motor by a belt. The input shaft extends through an actuator cam and a brake assembly positioned between the transmission and the pulley. The actuator cam cooperates with a brake hub to actuate, i.e., release and engage, the brake.

The actuator cam is supported on an angular contact bearing assembly which includes a snap ring secured within a groove machined into an input tube. The input shaft extends through the input tube. A counter bore is machined into the actuator cam, and an angular contact bearing is positioned within the counter bore. The angular contact bearing is supported by the snap ring. A washer typically is located between the snap ring and the angular contact bearing.

Since the angular contact bearing assembly is not easily accessible, the assembly generally must be "permanently" lubricated in that the assembly must be able to retain lubrication over its life without requiring replenishment. Further, the above described angular contact bearing assembly is expensive to fabricate. For example, machining a counter bore in the actuator cam and machining a slot in the input tube to receive the snap ring are time consuming and labor intensive fabrication processes.

In operation, when the machine is to operate in the spin cycle, rotation of the actuator cam causes the brake hub to lift away from the cam and the brake releases. Under these conditions, significant downward axial forces are generated. As a result, the angular contact bearing assembly is subjected to high stresses due to the significant downward axial forces and also is subjected to low amplitude vibrations generated during the spin cycle.

It would be desirable to reduce the stresses on the bearing assembly and enable the bearing assembly to receive unlimited lubrication over its life. It also would be desirable to provide such an angular contact bearing assembly which is less expensive to assemble than the angular contact bearing assembly described above.

SUMMARY OF THE INVENTION

These and other objects may be attained by a thrust bearing assembly located at an upper end of the input shaft just below an input pinion engaged to the upper end of the shaft. The thrust bearing assembly, in one embodiment, includes a cage and bearing assembly positioned between washers. The thrust bearing assembly is supported on a bronze flange bearing having a bore, and the input shaft extends through the bore. The flange bearing is supported by the transmission housing. The thrust bearing assembly is located within a lubrication reservoir formed by the transmission housing and the reservoir typically is filled with a lubricant.

In the above described configuration, the angular contact bearing assembly is eliminated. In addition, the counterbore in the actuator cam is eliminated. Therefore, the time consuming and labor intensive machining processes required with the known angle contact bearing assembly are eliminated, and the above described thrust bearing assembly is believed to be lower in cost than the known bearing assemblies.

In operation, the thrust bearing assembly absorbs the downward axial forces on the input shaft during the spin cycle. Specifically, when the machine operates in the spin cycle, the axial forces are transferred through the actuator cam, the pulley hub, and the shaft to the input pinion. The input pinion rides on the upper washer of the bearing assembly and, therefore, the downward forces on the input pinion are transferred to the thrust bearing.

The above described thrust bearing assembly is believed to have a high load capacity and easily handles the load generated during the spin cycle. Further, since the thrust bearing is located in the lubrication reservoir, the bearing should receive ample lubrication throughout its life and need not be a "permanently" lubricated type bearing. In addition, the bearings of the cage and bearing assembly are randomly oriented at the end of each agitation cycle and therefore, are less prone to wear.

DETAILED DESCRIPTION

Figure 1:
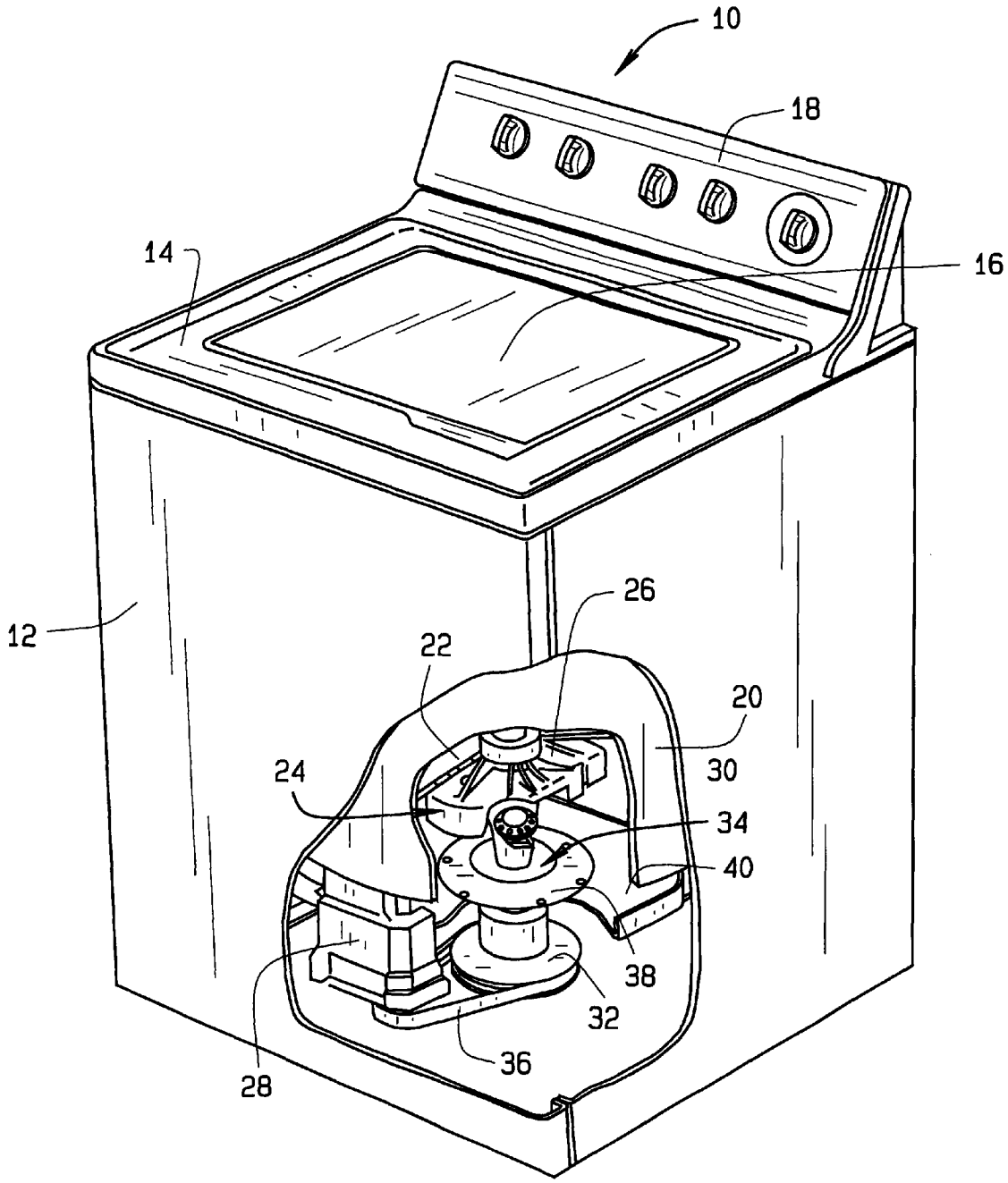
FIG. 1 is a perspective view of a washing machine with parts cut away.

FIG. 1 is a perspective view of a washing machine 10 with parts cut away. Washing machine 10 is shown for illustrative purposes only and not by way of limitation. The present thrust bearing assembly can be utilized in connection with many other washing machines. Washing machine 10 includes a cabinet 12 having a washer cover 14, and a lid 16 is rotatably mounted to washer cover 14. Washing machine 10 also includes a control panel 18. Washing machine 10 may, for example, be a washing machine commercially available from General Electric Company, Appliance Park, Louisville, Ky. 40225 modified to include a thrust bearing assembly described below in more detail.

Cabinet 12 encloses an outer water-retaining tub 20, and a basket 22 is located within tub 20. A transmission 24, including a transmission housing 26, is located below basket 22. Transmission 24 is coupled to an electric motor 28 by an input shaft 30. Input shaft 30 is engaged to and extends from a pulley 32, through a brake assembly 34, to transmission 24. Pulley 32 is driven by a belt 36 coupled to motor 28. A bearing retainer 38 is secured to a support platform, or frame, 40 and retainer 38 is coupled to brake assembly 34 as described below in more detail.

Figure 2:
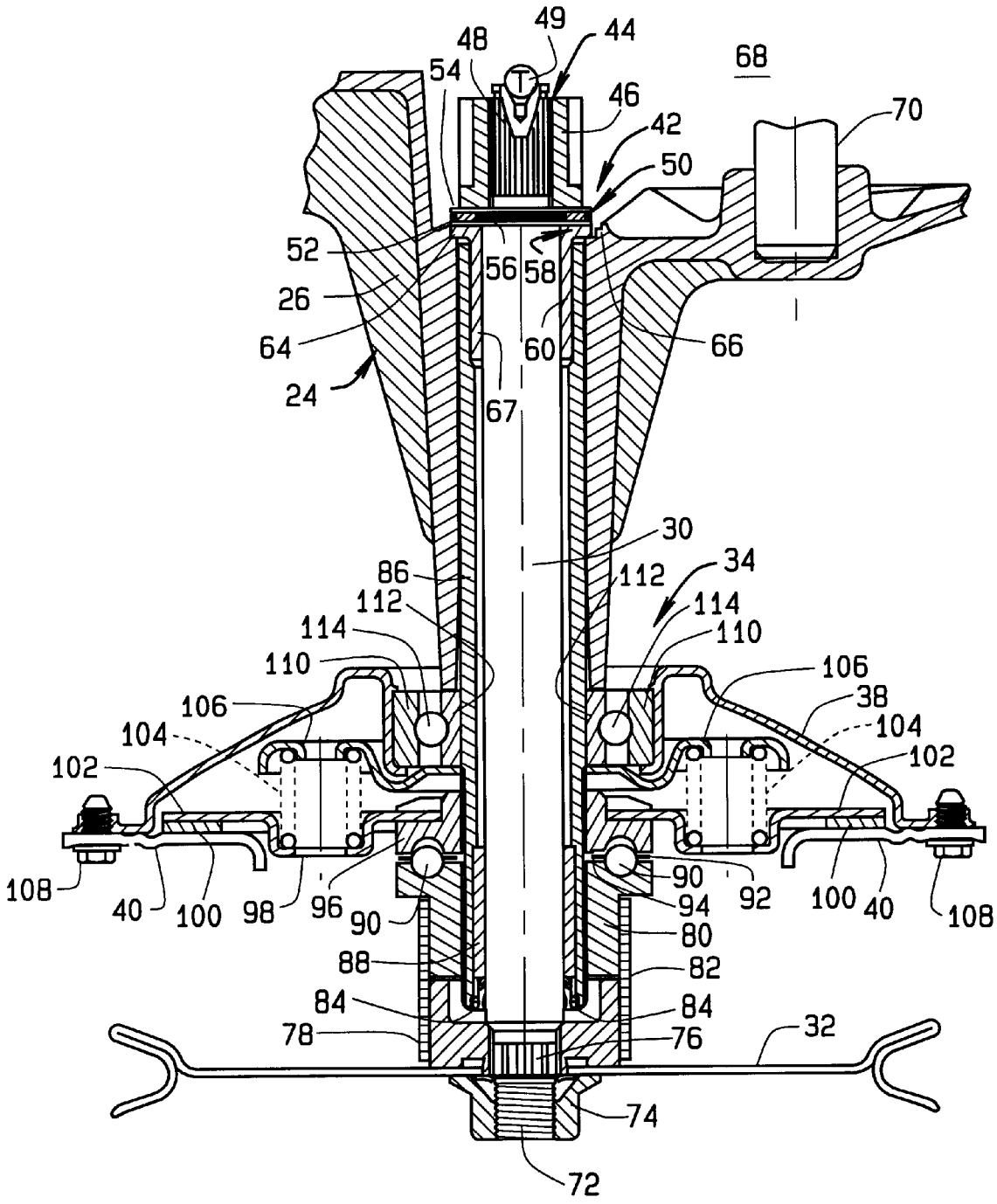
FIG. 2 is a cross sectional view of a thrust bearing assembly in accordance with one embodiment of the present invention.

FIG. 2 is a cross sectional view of a portion of transmission 24 and brake assembly 34 shown in FIG. 1, including thrust bearing assembly 42 in accordance with one embodiment of the present invention. Thrust bearing assembly 42 is located adjacent an upper end 44 of shaft 30 below an input pinion 46 engaged to shaft 30. End 44 of shaft 30 has splines 48, and splines 48 form a friction fit with input pinion 46 so that input pinion 46 rotates with shaft 30. Input pinion 46, as is known, connects shaft 30 to an eccentric gear. A ball 49 at end 44 of shaft 30 locates shaft 30 axially with respect to an agitator shaft (not shown) as is known in the art.

Figure 3:
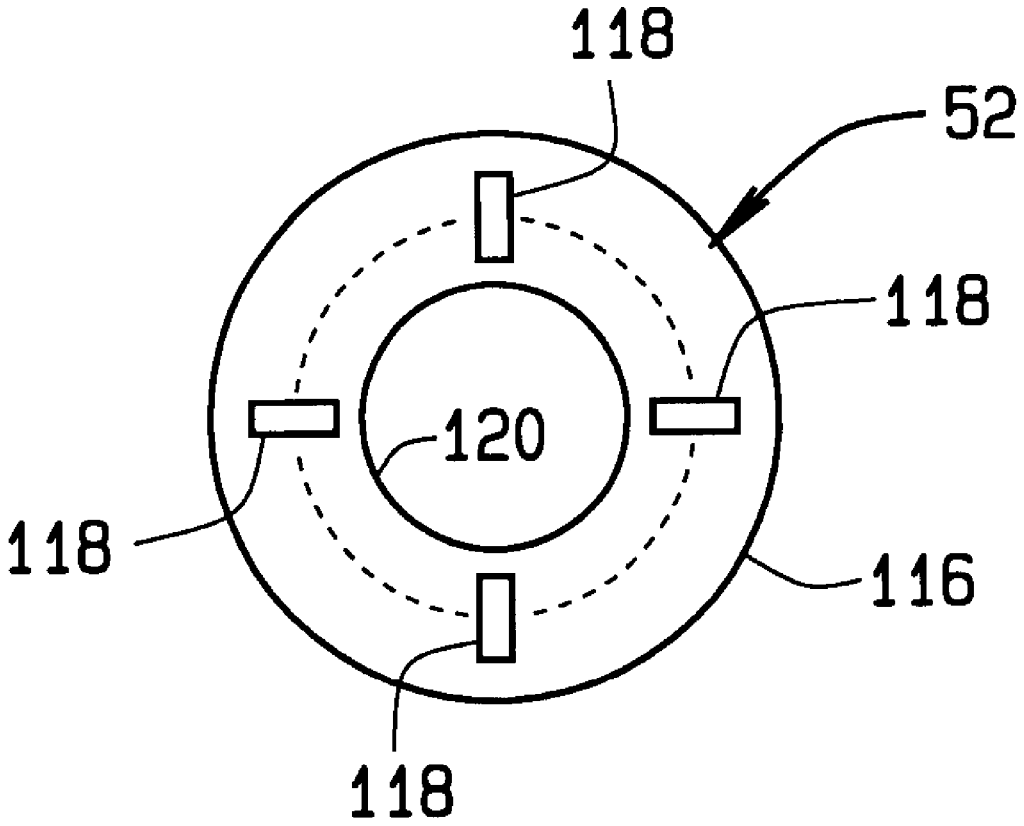
FIG. 3 is a top view of a cage and roller bearing assembly which may be used in the thrust bearing assembly shown in FIG. 2.

Thrust bearing assembly 42 includes a thrust bearing 50 which is shown in FIG. 3 as being a cage and roller bearing assembly 52 positioned between upper and lower washers 54 and 56. Input shaft 30 extends through assembly 52 and washers 54 and 56. Cage and roller bearing assemblies are well known in the art. Of course, other known types of bearing assemblies can be utilized as thrust bearing 50.

A support 58 for thrust bearing assembly 50 includes a bronze flange bearing 60 having a bore 62 through which shaft 30 extends. Flange bearing 60 has an annular flange 64 which is in contact with, and supported by, transmission housing 26 on a ledge 66. A lubrication reservoir 68 is formed by housing 26 and typically is filled with a lubricant. An idler shaft 70 also is supported by housing 26 as is known in the art.

Referring now to lower end 72 of shaft 30, end 72 is threaded and is engaged to a pulley nut 74. Nut 74 is tightened against pulley 32. Splines, or ribs, 76 are formed adjacent threaded end 72 of shaft 30, and splines 76 form a friction fit with a pulley hub 78. An actuator cam 80 is positioned over pulley hub 78 and a one-way spring clutch 82 is positioned around both hub 78 and cam 80. Oil seals 84 are located adjacent input shaft 30 below an input tube 86 and a sleeve bearing 88.

Actuator cam 80 supports bearing balls 90 located within a ball cage 92. Ball cage 92 includes, in one specific embodiment, six openings and six balls 92 are located in each respective opening. Ball cage 92 facilitates synchronizing movement of balls 92. A retainer ring 94 engaged to input tube 86 limits movement of actuator cam 80. Specifically, cam 80 is trapped between ring 94 and pulley hub 78. In one specific embodiment, bearing balls 90 are located on ramps formed in the upper surface of cam 80, and each ramp has an angle of about six degrees upward as measured from a non-actuating position to a fully actuating position of balls 90 as described in below. It is believed that in combination thrust bearing assembly 42, by modifying an end section of each ramp to have an increased angle of about nine degrees, improved performance is possible.

A brake hub 96 is located over balls 92, and brake hub is engaged to a brake disc 98. Brake material 100 is secured to ends 102 of brake disc 98. Compression springs 104 extend from brake disc 98 to a spring retainer 106. Typically, three compression springs 104 are utilized and are equally spaced around input shaft 30 (i.e., one hundred and twenty degrees spacing). Only two springs 104 are shown in FIG. 2, and it should be understood that springs 104 are spaced at one hundred and twenty degrees even through both springs 104 are shown in cross-section.

As described above, bearing retainer 38 is secured to support platform 40 by bolts 108. Retainer 38 is secured to an outer race 110, and an inner race 112 is secured by a slip fit to input tube 86. Ball bearings 114 are positioned between outer race 110 and inner race 112.

FIG. 3 is a top view of cage and roller bearing assembly 52. As shown in FIG. 3, assembly 52 includes a cage 116, and roller bearings 118 are trapped in cage 116. In one specific embodiment, input shaft 30 has a diameter of about ⅝, and a diameter of opening 120 in cage 116 is slightly greater than ⅝. Also, twenty roller bearings 118 are used in the one specific embodiment.

Generally, and in the spin mode of operation, pulley 32 is driven by motor 28 to rotate in a first direction, and shaft 30 and pulley hub 78 rotate with pulley 32. Spring clutch 82 tightens around actuator cam 80 thereby causing cam 80 to rotate with hub 78. As cam 80 rotates, bearing balls 90 are ride up on the ramps of cam 80 to the actuating position and cause brake hub 96 to lift, which in turn compresses springs 104 and brake disc 98 lifts away from platform 40. When brake material 100 is completely lifted away from platform 40, shaft 30 will freely rotate along with brake hub 96 and disc 98, inner race 112, transmission 24, actuator cam 80, and pulley hub 78.

Under these conditions, significant axial forces are generated, and these forces act on actuating cam 80. The forces are transferred through cam 80 and pulley hub 78 to shaft 30. At upper end 44 of shaft 30, these forces are transferred through input pinion 46 to thrust bearing assembly 42. Assembly 42 is supported by housing 26 and substantially absorbs these axial forces while allowing free rotation of shaft 30. Further, upper washer 54 of assembly 42 typically rotates with input pinion 46 and lower washer 56 typically rotates with flange bearing 60. Pinion 46 and flange bearing 60, however, do not rotate together and, assembly 42 also accommodates this relative rotation.

Thrust bearing assembly 42 is believed to have a high load capacity and easily handles the axial loads described above. Further, since at least thrust bearing 50 is located in lubrication reservoir 68, bearing 50 receives ample lubrication throughout its life and need not be a "permanently" lubricated type bearing. In addition, the bearings of cage and bearing assembly 52 are randomly oriented at the end of each agitation cycle and therefore, are less prone to wear. Also, thrust bearing assembly 42 is believed to be lower in cost than the known bearing assemblies.

Generally, and in the agitate mode of operation, pulley 32 rotates in a second direction which causes shaft 30 and pulley hub 78 to rotate. When rotated in the second direction, one-way spring clutch 82 does not tighten around actuator cam 80. Therefore, cam 80 does not significantly rotate, and brake assembly 34 is engaged to prevent rotation of transmission 24. Such rotation of shaft 30 is utilized to generate the agitation motion as is known in the art.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A thrust bearing assembly for a washing machine, the washing machine including a cabinet substantially enclosing an outer water-retaining tub and a basket located within the tub, the machine further including a transmission coupled to an electric motor by an input shaft, the transmission including a transmission housing, a pulley engaged to the input shaft at one end thereof and a belt extending around the pulley and coupled to the motor, the input shaft coupled to and extending from the pulley, the shaft extending through a pulley hub and a brake assembly to a pinion gear located within the transmission housing, said thrust bearing assembly comprising:

a thrust bearing coupled to the input shaft at an upper end thereof; and a flange bearing supporting said thrust bearing on the transmission housing.

2. A thrust bearing assembly in accordance with claim 1 wherein said thrust bearing comprises a cage and bearing assembly.

3. A thrust bearing assembly in accordance with claim 2 further comprising at least two washers, said cage and bearing assembly located between said washers.

4. A thrust bearing assembly in accordance with claim 1 wherein a bore extends through said flange bearing, and the input shaft extends through the bore to the flange bearing.

5. A thrust bearing assembly in accordance with claim 1 wherein said flange bearing comprises an annular flange.

6. A thrust bearing assembly in accordance with claim 5 wherein said annular flange is in contact with, and supported by, the transmission housing.

7. A thrust bearing assembly in accordance with claim 1 wherein a lubrication reservoir is formed by the transmission housing, and said thrust bearing is lubricated by lubrication in the reservoir.

8. A thrust bearing assembly in accordance with claim 1 wherein axial forces are transferred through the brake assembly, the pulley hub, and the input shaft to said thrust bearing.

9. A thrust bearing assembly in accordance with claim 8 wherein a lubrication reservoir is formed by the transmission housing, and said thrust bearing is lubricated by lubrication in the reservoir.

* * * * *